United States Patent [19]

Moudgil

[11] 4,208,272

[45] Jun. 17, 1980

[54] SEPARATION OF LIMESTONE FROM LIMESTONE ORE

[75] Inventor: Brij M. Moudgil, Ontario, Calif.

[73] Assignee: Occidental Research Corporation, La Verne, Calif.

[21] Appl. No.: 897,740

[22] Filed: Apr. 19, 1978

[51] Int. Cl.[2] ..... B07C 5/02; B07C 5/34

[52] U.S. Cl. ..... 209/3.3; 209/576

[58] Field of Search ..... 209/3.1, 3.2, 3.3, 1, 209/3, 4, 9, 578, 576, 577, 580–582

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson et al. | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1974 | Sawyer | 209/3.1 |
| 3,992,287 | 11/1976 | Rhys | 209/2 |

*Primary Examiner*—Allen N. Knowles
*Attorney, Agent, or Firm*—Barry A. Bisson

[57] ABSTRACT

A method for the separation of limestone from a particulate limestone ore containing particles of limestone and gangue which comprises conditioning the limestone ore with at least one coupling agent selected from saturated and unsaturated carboxylic acids containing from about 4 to about 22 carbon atoms, or at least one coupling agent selected from the group consisting of aliphatic amines containing from about 8 to about 22 carbon atoms, and beta amines containing from about 7 to about 21 carbon atoms, to selectively coat the limestone or the gangue in the ore to the substantial exclusion of the other in combination with providing at least one fluorescent dye to said coupling agent; radiating the conditioned ore to excite and induce fluorescence of the fluorescent dye to a degree sufficient to distinguish the coated particles from the non-coated particles and separating the fluorescing, coated particles from the non-fluorescing, non-coated particles.

25 Claims, No Drawings

SEPARATION OF LIMESTONE FROM LIMESTONE ORE

BACKGROUND OF THE INVENTION

The present invention relates to a method for the separation of limestone from limestone ore. More particularly, it relates to a method for separating limestone from iron-bearing rock, chert, granite, quartz, and other silicates present in limestone ore, especially calcium carbonate from quartz and/or other silicates.

Limestone is a common mineral and appears in many different concentrations in different limestone containing ores. Also present in these limestone ores are impurities such as chert, iron-bearing rock, granite, quartz, and various other silicates. All such impurities are hereinafter referred to as gangue. The limestone ore as mined must be upgraded to obtain the beneficial properties of the limestone and to produce limestone of the desired quality for commercial uses such as in the glass and cattle feed industries. Further, the limestone for use in cement manufacture must also meet specifications, especially with respect to alkaline material.

It is the general practice to separate limestone from the gangue by methods that have distinguished between the physical properties of the limestone and gangue. Such methods include handsorting or optical sorting of the limestone ore. Handsorting is slow and tedious and is economically unattractive. Optical sorting is limited because of difficulty in the resolution of colors and the difficulty of distinguishing among the various shades of colors in limestone and gangue rock. Limestone ore may be upgraded with respect to alkaline material by selective mining; but with selective mining, much limestone is left unmined and thereby unusable. Flotation concentration has also been used to upgrade limestone, but flotation processing costs are relatively high and as such economically unattractive.

SUMMARY OF THE INVENTION

In accordance with this invention there is disclosed a method for the separation of higher-grade limestone from lower-grade limestone and the gangue present in particulate limestone ore which comprises conditioning the particulate limestone ore with at least one coupling agent selected from saturated and unsaturated carboxylic acids containing from about 4 to about 22 carbon atoms, said coupling agent selectively coating the calcium carbonate in the limestone to the substantial exclusion of coating gangue in combination with providing at least one fluorescent dye to said coupling agent; radiating the conditioned particulate limestone ore to excite and include fluorescence of the fluorescent dye to a degree sufficient to distinguish the coated higher-grade limestone particles from the lesser coated lower-grade limestone and the substantially non-coated gangue particles and separating the fluorescing coated higher-grade limestone particles from the less fluorescing coated lower-grade limestone and substantially non-fluorescing gangue particles.

Further, in accordance with this invention there is disclosed a method for the separation of higher-grade limestone from lower-grade limestone and/or the silicate-containing gangue present in particulate limestone ore comprising conditioning the particulate limestone ore with at least one coupling agent selected from the group consisting of aliphatic amines containing from about 8 to about 22 carbon atoms and beta amines containing from about 7 to about 21 carbon atoms, said coupling agent selectively coating the silicates in the particles to the substantial exclusion of coating the calcium carbonate in the particles, in combination with providing at least one fluorescent dye to said coupling agent; radiating the conditioned particulate limestone ore to excite and induce fluorescence of the fluorescent dye to a degree sufficient to distinguish the coated gangue particles and lesser coated lower-grade limestone from the least coated higher-grade limestone particles and separating the fluorescing, coated gangue and lower-grade limestone particles from the higher-grade limestone particles.

To provide the dye to the coupling agent coated particles to the substantial exclusion of the non-coated particles, the coupling agent is water insoluble when the fluorescent dye is water insoluble. However, a water soluble coupling agent and a water insoluble dye can be used to provide a dye-coupled to the coating on a selected particle. For example, a water soluble amine coupling agent can be coated on one substance (e.g., the silicates) in a mixture of particles then applying an oil soluble dye such as fluoranthene in a nonreactive oil such as a paraffinic oil (e.g., S.A.E. 20 base lubricating oil without additives). The silicate particles are rendered hydrophobic or oleophilic by the amine coating, which attracts the water insoluble dye in the oil thereby coupling the dye to the coated particles.

Water soluble coupling agents and water soluble dyes can be used if a chemical bond is formed during conditioning having sufficient strength to avoid removal during the subsequent stages of the method such as a subsequent rinsing step. Also, nonreactive water soluble dyes and water soluble coupling agents can be used if not removed in the subsequent steps of the method. For example, a water soluble dye can be applied at a temperature which is higher than the temperature of the subsequent steps (e.g., a hot dye application and a cold rinse). Also exemplary, a water soluble amine can be used as a coupling agent, whereupon following conditioning of the particles with the amine a prepolymer forming agent, such as formaldehyde, is added forming a prepolymer with the amine which upon subsequent contact with acid and/or heat polymerizes forming a water insoluble coating.

To provide the dye to the particles which are selectively non-coated with the coupling agent to the substantial exclusion of the coated particles, a water insoluble coupling agent and a water soluble dye, or a water soluble coupling agent and a water insoluble dye can be used. For example, a water insoluble coupling agent such as oleic acid can be applied to one substance within a mixture of particles (e.g., the limestone), then the entire mixture can be exposed to an aqueous water soluble dye, such as rhodamine B, flavine FF, or uranine, whereby the water insoluble coupling agent renders the limestone particle hydrophobic wherein the dye does not adhere but wherein the dye does adhere to the hydrophilic non-coated particles. In such an application of the method of this invention, a relatively gentle stream of air can be used to remove small droplets of the water soluble dye from the hydrophobic particles, thus eliminating the need for a subsequent rinse step in the method. The rinse step can also be eliminated in the practice of the method of this invention, if the concentration of the coupling agent and the concentration of the dye is sufficiently low.

It is understood, of course, that the principles described herein can be used to separate a higher-grade limestone from a lower-grade limestone as the coated higher-grade limestone particles have a greater intensity of fluorescence than the lower-grade limestone particles. The higher-grade and lower-grade limestone particles can thereby be separated by adjusting the sorting apparatus to accept those particles exhibiting fluorescence above a certain minimum intensity level and rejecting those particles exhibiting no fluorescence and/or fluorescence below such minimum intensity level.

DETAILED DESCRIPTION OF THE INVENTION

According to the present invention, there is provided a method for the separation of limestone from gangue present in limestone ore to recover limestone values therefrom. As used herein the phrase "separation of limestone from gangue" includes the separation of higher-grade limestone from lower-grade limestone as well as separation of limestone from gangue. By the terms "higher-grade limestone" and "lower-grade limestone" is meant a relative distinction in calcium carbonate content between two grades of limestone. Such as relative distinction can be variable depending upon the reasoning for distinguishing between limestone grades such as grading the limestone in consonance with the numerous end uses of the limestone. The practice of the method of this invention involves the selective coating of either the limestone or gangue present in the limestone ore with a coupling agent or mixture of coupling agents and combined therewith a fluorescent dye, radiating the limestone ore with electromagnetic radiation to induce the fluorescent dye on the conditioned, selectively coated particles to fluoresce. The fluorescent material is then separated from the lesser fluorescing and/or substantially nonfluorescing material.

The method of the present invention is based upon the differences in surface properties of the various material present in limestone ores to accept coupling agents and dyes attracted thereto or repulsed thereby. Due to these differences, there can be chosen a coupling agent or mixture of coupling agents that will effectively selectively coat only the limestone or the gangue. Surface properties are relatively more consistent than other properties such as color, reflectance, or conductivity. These other properties generally tend to be similar such that a fine degree of resolution is required to distinguish between the materials. Such a degree of resolution is difficult to obtain and the efficiency of separation based upon these properties, therefore, suffers. Separation of material based upon the surface properties is, therefore, more consistent than techniques based upon the above other properties.

To distinguish between the coupling agent coated material and the non-coated material, there is incorporated with the coupling agent a tagging agent such as a fluorescent dye or there is added a tagging agent, such as a fluorescent dye, that is repulsed by the coupling agent. The ore can then be radiated with electromagnetic radiation to induce the dye to fluoresce. The dye combined with the coupling agent coating some of the material fluoresces and the substantially non-coated material does not fluoresce to any substantial degree, or if the dye is repulsed by the coupling agent, the non-coupling-agent-coated particles exhibit fluorescence while the coupling agent coated particles do not fluoresce to any substantial degree. Thereby, the different materials can be separated.

Generally, fluorescence refers to the property of absorbing radiation at one particular wavelength and simultaneously re-emitting light of a different wavelength so long as the stimulus is active. It is intended in the present method to use the term fluorescence to indicate that property of absorbing radiation at one particular wavelength and re-emitting it at a different wavelength, whether or not visible, during exposure to an active stimulus or after exposure or during both these time periods. Thus, fluorescence is used generically herein to include fluorescence, phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the fluorescent dye. Thus, electromagnetic radiation is used generically herein to include electromagnetic radiation and envisions other stimuli that will excite and induce fluorescence of the fluorescent dye.

In practicing the present method in regard to limestone ore, the ore is first subjected to a crushing step. In this crushing step, the ore is crushed to physically separate the limestone from the gangue present. Crushing increases the surface area of the particles and further provides a greater surface and reactive site for the coating of the particles by the coupling agent. The limestone ore is crushed to a particle size of from about ¼ inch to about 8 inches. Particle sizes of less than ¼ inch can be used in the practice of this invention; however, such sizes require greater amounts of coupling agent and are more difficult to separate. Particle sizes of greater than 8 inches can be used in the practice of this invention, but generally entrain impurities such that separation efficiency decreases. It is preferred to use ore particles of from about ½ inch to about 3 inches. Following the crushing and sizing steps the limestone ore particles can be deslimed to remove soluble impurities and surface fines on the particles.

The method of this invention is practiced in regard to limestone ore by conditioning the limestone ore following sizing with a coupling agent or mixture of coupling agents that selectively adheres to the limestone or the gangue present in the limestone ore. It is preferred to condition the limestone ore with a coupling agent or mixture of coupling agents that selectively coats the limestone in the ore. The coupling agents that are selective for limestone are more selective than the coupling agents for the gangue. Thus, the coupling agents selective for the gangue are less efficient to use in separating the limestone from the gangue than the coupling agents selective for limestone.

Coupling agents that are useful in the practice of this method to coat the calcium carbonate present in the limestone particles can be selected from saturated and unsaturated carboxylic acids including fatty acids which contain from about 5 to about 22 carbon atoms, or a mixture thereof. Carboxylic acids that can be used include palmitoleic acid, oleic acid, linoleic acid, caproic acid, caprylic acid, capric acid, lauric acid, myristic acid, palmitic acid, stearic acid, arachidic acid, behenic acid, tall oil fatty acids and the like. It is preferred to use at least one carboxylic acid containing from about 8 to about 18 carbon atoms. Carboxylic acids containing more than about 22 carbon atoms can be used, but generally tend to be less selective and thereby coat both limestone and gangue particles. Carboxylic acids of less than 5 carbon atoms generally do not possess the ability to coat any of the particles. In general, the preferred carboxylic acid enters a chemical reaction with the calcium carbonate; for example, oleic acid reacts to form calcium oleate.

To coat the silicate-containing gangue present in limestone ore a coupling agent is selected from aliphatic amines, or a mixture thereof, containing from about 8 to about 22 carbon atoms and beta amines or mixture thereof containing from about 7 to about 21 carbon atoms. Aliphatic amines useful in the method of this invention include octyl amine, decyl amine, dodecyl amine, tetradecyl amine, hexadecyl amine, octadecyl amine, eicosanyl amine, docosanyl amine and the like. Beta amines can include commercially available beta amines such as ARMEEN L-7 through L-15 series, which are registered trademarked products of Armak Chemicals and are known to those skilled in the art. Generally, the amines containing more than about 22 carbon atoms are not as selective as the amines containing less than about 22 carbon atoms. Aliphatic amines of less than about 8 carbon atoms and beta amines of less than about 7 carbon atoms generally do not have the desired coating properties. It is preferred to use an aliphatic amine containing from about 10 to about 18 carbon atoms and a beta amine containing from about 7 to about 15 carbon atoms. Of the amines the beta amines are more selective for silicates rather than calcium carbonates and therefore are preferred. A water soluble amine coupling agent selected from the water soluble salts of the above identified aliphatic and beta amines can also be used.

A fluorescent dye is combined with the coupling agents used to condition the limestone ore. The fluorescent dye can be combined with the coupling agent either before or after the ore is conditioned. Fluorescent dyes known to those skilled in the art, and which are compatible with the coupling agents, can be used in the practice of the method of this invention. It is preferred to use a water insoluble fluorescent dye when a water insoluble coupling agent is used. Water soluble fluorescent dyes can dissolve into the water dispersant during the conditioning step and can thereby impart a fluorescing property to substantially all the particles if an aqueous layer coats their surface. Fluorescent dyes that can be used include fluoranthene, Fluorescent Yellow G (a product of Morton Norwich Chemical Co.), rhodamine B, flavine FF, uranine and the like. The fluorescent dye can be used in any form such as a solution, suspension, emulsion, dispersion, or alone. The fluorescent dye can be combined with the coupling agent prior to conditioning the ore by either mixing the fluorescent dye directly with the coupling agent or by mixing the fluorescent dye with a suitable diluent or solvent, such as an oil, then mixing with the coupling agent. If the fluorescent dye is combined with the coupling agent following the conditioning, it can be applied directly to the conditioned ore or it can be used in any of the above-mentioned convenient forms. The fluorescent dye has an affinity toward the coupling agent coating and will, therefore, be preferentially entrained in only the coated ore particles. Any dye that adheres to the non-coated particles, generally, is removed by an aqueous wash of the ore. It is preferred to combine the coupling agent and fluorescent dye prior to conditioning the ore. Such prior treatment uses less fluorescent dye, requires fewer steps, and is generally more efficient both economically and in separation results.

Following the crushing and sizing of the limestone ore, the ore is conditioned with the coupling agent. Conditioning of the ore with the coupling agent is accomplished by contacting the sized ore with the coupling agent. The coupling agent can be used in any suitable manner such as in solution, dispersion, or by itself. It is preferred to form a dispersion of the coupling agent in water. Many methods of contacting the ore with the aqueous dispersion are available and known to those skilled in the art. Such methods include the spraying of the aqueous dispersion onto the sized ore, the passing of the ore through a dispersion bath, and the like. It is preferred to spray the sized ore with the aqueous dispersion. Spraying techniques include, but are not limited to, spraying the dispersion onto the ore as the ore passes the spraying nozzle on a vibrating screen or belt, or spraying the ore as it passes through a ring or series of ring sprayers. Such as is shown in United States Application Ser. No. 897,946 filed on the same day as the present application by Moudgil and Roeschlaub, entitled METHOD AND APPARATUS FOR SELECTIVE WETTING OF PARTICLES, the entire disclosure of which is incorporated herein by this reference.

Following the spraying of the ore with the aqueous dispersion, the ore is rinsed with a suitable washing agent, such as water, to remove excess dispersion from the ore and any dispersion physically entrained in the ore. The coupling agent, combined with the fluorescent dye, will selectively remain coated on the particles for which it has a preference due to the surface properties of the particles. The coated particles are capable of fluorescence when radiated with electromagnetic radiation. As the coupling agents are preferential, they selectively coat either the limestone or the gangue in the limestone ore. The ore particles not coated generally will not fluoresce to the same degree as the coated particles.

Following the conditioning of the limestone ore, the ore is exposed to electromagnetic radiation to induce the coating on the particles to fluoresce. The coated, fluorescing particles can be separated by any convenient means such as by hand, by optical sorting device, and by apparatus as taught by Matthews' U.S. Pat. No. 3,472,375, which is incorporated herein by reference. In such apparatus a free falling mixture of ore passes in front of a row of detectors. Each detector by proper attenuation is capable of distinguishing between non-fluorescence and fluorescence or in intensity of fluorescence. Each detector in turn controls one flowing fluid stream selectively directed transverse to the path of the falling particle, the fluid stream being permitted to impinge only on the properly emitting ore particles. The directed fluid stream deflects the ore particles into a divergent path by which they are separated from the undesired ore particles. Such an apparatus is capable of detecting and separating the coupling agent and dye-coated particles from the non-coated particles.

The invention is further illustrated by the following examples, which are not intended to be limiting.

EXAMPLE 1

A quantity of crushed limestone ore, consisting of 47.5% by weight limestone with an average particle size of about ¾ inch and primarily containing limestone, chert, iron-bearing rock, granite, quartz, and various other silicates, was conditioned with a coupling agent of oleic acid combined with fluoranthene fluorescent dye. The oleic acid had been combined with fluoranthene by dissolving the fluoranthene in oil (e.g., S.A.E. 20 base lubricating oil without additives) and mixing it with oleic acid. An aqueous dispersion of oleic acid combined with fluoranthene was made. This aqueous dispersion was sprayed onto the crushed and sized ore. The oleic acid coupling agent combined with fluoranthene selectively coated the limestone particles and was rejected by the gangue particles in the ore. The excess aqueous dispersion was washed from the ore with a water wash.

The coated limestone particles were separated from the non-coated gangue particles by the use of a Matthews' separator apparatus by passing free falling particles of the ore in front of an electromagnetic radiating source and sequentially, fluorescence detectors. The coated limestone particles fluoresced substantially to a greater degree than the gangue when radiated. Each detector had been attenuated to detect fluorescence of the coated particles and each controlled one flowing fluid stream selectively directed transverse to the path of the falling particles. The fluid stream impinged only on the fluorescing ore particles. The directed fluid streams deflected the fluorescing limestone particles on a divergent path from the free falling gangue particles.

The limestone particles separated contained 94.3% limestone and there was 93.7% recovery of the limestone present in the initial feed material.

EXAMPLE 2

The procedure of Example 1 was repeated in all essential details except that the limestone ore was crushed to a particle size of about 1.5 inches and the coupling agent used was caprylic acid combined with fluoranthene fluorescent dye. The caprylic acid selectively coated the limestone particles and was rejected by the gangue. The initial limestone ore contained 77.8% by weight limestone. The fluorescing limestone particles separated from the nonfluorescing gangue particles contained 99.5% limestone.

The limestone particles recovered by the method of this invention constituted 88.9% of the limestone present in the initial feed.

EXAMPLE 3

The procedure of Example 1 was repeated in all essential details. The initial limestone concentration in the ore was 45.1% by weight and the limestone concentration in the recovered fluorescing limestone particles was 95%. The total limestone recovered by the method of this invention was 87% of the limestone present in the initial feed.

EXAMPLE 4

The procedure of Example 1 was repeated in all essential details except the initial limestone ore was crushed to a particle size of from 0.5 to 2.5 inches and the coupling agent used was ARMEEN L-9, a trademarked product of Armak Chemicals which is a beta amine containing 9 carbon atoms. The ARMEEN L-9 coupling agent was combined with fluoranthrene fluorescent dye. The ARMEEN L-9 coupling agent selectively coated the gangue present in the limestone ore.

The initial limestone ore contained by weight 25.13% silicates, 0.93% $Fe_2O_3$, 35.65% CaO and 1.07% $K_2O$. The limestone particles separated by the method of this invention fluoresced at a lesser intensity than the gangue particles and contained 1.07% silicates, 0.23% $Fe_2O_3$, 53.12% CaO and 0.12% $K_2O$. The fluorescing gangue separated contained 42.99% silicates, 1.45% $Fe_2O_3$, 22.77% CaO and 1.79% $K_2O$.

ARMEEN L-11 and ARMEEN L-15 can also be used in the experiment of this Example 4, however, the ARMEEN L-9 has the greater selectivity for silicates versus calcium carbonate.

EXAMPLE 5

The procedure of Example 1 was repeated in all essential details except the initial limestone ore was crushed to a particle size of from 0.5 to 2.5 inches and the coupling agent used to condition the ore was tall oil fatty acid combined with fluoranthene dye. The tall oil fatty acid coupling agent selectively coated the limestone and thereby caused the limestone particles to fluoresce when exposed to electromagnetic radiation.

The initital limestone ore contained 5.04% silicates, 0.24% $Fe_2O_3$, 51.14% CaO and 0.16% $K_2O$ by weight. The fluorescing limestone particles separated by the method of this invention contained 0.53% silicates, 0.13% $Fe_2O_3$, 53.58% CaO and 0.95% $K_2O$. The lesser fluorescing lower grade limestone separated contained 10.39% silicates, 0.38% $Fe_2O_3$, 45.82% CaO and 0.28% $K_2O$.

EXAMPLE 6

The procedure of Example 5 was repeated in all essential details.

The initial limestone ore contained 11.95% silicates, 0.6% $Fe_2O_3$, 46.6% CaO and 0.05% $K_2O$ by weight. The fluorescing limestone particles separated by the method of this invention contained 5.65% silicates, 0.40% $Fe_2O_3$, 50.15% CaO and 0.93% $K_2O$. The lesser fluorescing lower grade limestone separated contained 42.70% silicates, 1.53% $Fe_2O_3$, 29.52% CaO and 0.05% $K_2O$.

EXAMPLE 7

The procedure of Example 4 was repeated in all essential details.

The initial limestone ore contained 8.98% silicates, 0.34% $Fe_2O_3$, 47.52% CaO and 0.68% $K_2O$ by weight. The lesser fluorescing limestone particles separated from the gangue particles by the method of this invention contained 0.55% silicates, 0.10% $Fe_2O_3$, 53.73% CaO and 0.04% $K_2O$. The fluorescing gangue particles contained 24.18% silicates, 0.77% $Fe_2O_3$,36.51% CaO and 1.8% $K_2O$.

EXAMPLE 8

The procedure of Example 4 is repeated in all essential details except decyl amine is selected as the coupling agent. The decyl amine coupling agent selectively coats the gangue present in the limestone ore. The fluorescing gangue particles are separated from the lesser fluorescing limestone particles.

EXAMPLE 9

The procedure of Example 4 is repeated in all essential details except the coupling agent selected is n-dodecyl amine. The n-dodecyl amine coupling agent selectively coats the gangue present in the limestone ore.

The fluorescing gangue are separated from the lesser fluorescing limestone particles.

The method of the present invention using the carboxylic acids as a coupling agent can also be used to separate calcite from magnesite and dolomite from magnesite.

The method of the present invention can also be used in optical, nonfluorescent separation systems by substituting for the fluorescent dye described herein, a dye that provides a distinct color within the visible spectrum.

What is claimed is:

1. A method for the separation of higher-grade limestone from lower-grade limestone and gangue present in particulate limestone ore which comprises: conditioning particulate limestone ore by contacting it with at least one coupling agent selected from saturated and unsaturated carboxylic acids containing from about 4 to about 22 carbon atoms; combining with said coupling agent at least one fluorescent dye before or after conditioning the particulate limestone ore with the coupling agent, said coupling agent selectively coating calcium carbonate in the particulate limestone ore to the substantial exclusion of coating gangue; exposing the conditioned particulate limestone ore to electromagnetic radiation to excite and induce fluorescence of the fluorescent dye to a degree sufficient to distinguish the coated higher-grade limestone particles from the lesser coated lower-grade limestone and the substantially non-coated gangue particles and separating the fluorescing higher-grade limestone particles from the lesser fluorescing lower-grade limestone and substantially non-fluorescing gangue particles.

2. The method of claim 1 wherein the particulate limestone ore is of a particle size of from about ¼ inch to about 8 inches.

3. The method of claim 2 wherein the particulate limestone ore is of a particle size of from about ½ inch to about 3 inches.

4. The method of claim 1 wherein said coupling agent is at least one carboxylic acid containing from about 8 to about 18 carbon atoms.

5. The method of claim 1 wherein said coupling agent is oleic acid.

6. The method of claim 1 wherein said coupling agent is caprylic acid.

7. The method of claim 1 wherein said coupling agent is a tall oil fatty acid.

8. The method of claim 1 wherein said fluorescent dye is combined with the coupling agent after the conditioning of the ore.

9. The method of claim 1 wherein said fluorescent dye is combined with the coupling agent after the conditioning of the ore.

10. The method of claim 1 wherein said fluorescent dye is oil soluble.

11. The method of claim 10 wherein said fluorescent dye is selected from the group consisting of fluorenthene, fluorescent yellow G and mixtures thereof.

12. A method for the separation of higher-grade limestone from lower-grade limestone and the silicate-containing gangue present in particulate limestone ore, comprising: conditioning particulate limestone ore by contacting it with at least one coupling agent selected from the group consisting of aliphatic amines containing from about 8 to about 22 carbon atoms and beta amines containing from about 7 to about 21 carbon atoms; combining with said coupling agent at least one fluorescent dye before or after conditioning the particulate limestone ore with the coupling agent, said coupling agent selectively coating silicates in the particles to the substantial exclusion of coating calcium carbonate in the particles, providing a coating on gangue particles, relative lesser coating on lower-grade limestone particles and relative least coating on higher-grade limestone particles, exposing the conditioned particulate limestone ore to electromagnetic radiation to excite and induce fluorescence of the fluorescent dye to a degree sufficient to distinguish the coated gangue particles and lesser coated lower-grade limestone from least coated higher-grade limestone particles and separating the fluorescing, coated gangue and lower-grade limestone particles from the higher-grade limestone particles.

13. The method of claim 12 wherein the particulate limestone ore is of a particle size of from about ¼ inch to about 8 inches.

14. The method of claim 13 wherein the particulate limestone ore is of a particle size of from about ½ inch to about 3 inches.

15. The method of claim 12 wherein the coupling agent is at least one aliphatic amine containing from about 8 to about 22 carbon atoms.

16. The method of claim 15 wherein said aliphatic amine is n-dodecyl amine.

17. The method of claim 12 wherein said coupling agent is at least one beta amine containing from about 7 to about 21 carbon atoms.

18. The method of claim 12 wherein said fluorescent dye is oil soluble.

19. The method of claim 18 wherein said fluorescent dye is selected from the group consisting of fluoranthene, Fluorescent Yellow G and mixtures thereof.

20. The method of claim 12 wherein said fluorescent dye is combined with the coupling agent prior to the conditioning of the ore.

21. The method of claim 12 wherein said fluorescent dye is combined with the coupling agent after the conditioning of the ore.

22. The method of claim 12 wherein the aliphatic and/or beta amine coupling agent comprises a water soluble salt of such an aliphatic and/or beta amine.

23. A method for the separation of higher-grade limestone from lower-grade limestone and the gangue present in particulate limestone ore which comprises: conditioning particulate limestone ore by contacting it with at least one coupling agent selected from saturated and unsaturated carboxylic acids containing from about 6 to about 22 carbon atoms, said coupling agent selectively providing a hydrophobic coating to calcium carbonate in the particles resulting in a coupling agent coating on higher-grade limestone particles and a lesser coating on lower-grade limestone particles to the substantial exclusion of coating gangue particles; adding a water soluble fluorescent dye to the conditioned ore wherein the water soluble dye is repulsed by the coupling agent coating providing a dye-coating on lesser coated lower-grade limestone particles and substantially non-coated gangue particles; exposing the limestone ore to electromagnetic radiation to excite and induce fluorescence of the fluorescent dye to a degree sufficient to distinguish gangue particles and lower-grade limestone particles from higher-grade limestone particles; and separating the fluorescing gangue and lower-grade limestone particles from the higher-grade limestone particles.

24. The method of claim 23 wherein the water soluble dye is selected from the group consisting of rhodamine B, uranine and flavine FF.

25. The method of claim 23 wherein the coupling agent is oleic acid.

* * * * *

UNITED STATES PATENT AND TRADEMARK OFFICE

CERTIFICATE OF CORRECTION

PATENT NO. : 4,208,272

DATED : June 17, 1980

INVENTOR(S) : Brij M. Moudgil

It is certified that error appears in the above—identified patent and that said Letters Patent is hereby corrected as shown below:

Column 1, line 53, change "include" to -- induce --;

Column 1, line 58, change "less" to -- lesser --;

Column 3, line 25, change "as" to -- a --;

Column 6, line 48, change "Matthews'" to -- Mathews' --;

Column 7, lines 17-18, change "Matthews'" to -- Mathews' --.

Signed and Sealed this

*Fourteenth* Day of *October 1980*

[SEAL]

*Attest:*

SIDNEY A. DIAMOND

*Attesting Officer*

*Commissioner of Patents and Trademarks*